US008011213B1

(12) United States Patent
Gogel

(10) Patent No.: US 8,011,213 B1
(45) Date of Patent: Sep. 6, 2011

(54) VERSATILE CROSS BAR DEVICE FOR CONTAINER DOOR STANCHIONS

(76) Inventor: Roy E. Gogel, Greenville, SC (US)

( * ) Notice: Subject to any disclaimer, the term of this patent is extended or adjusted under 35 U.S.C. 154(b) by 370 days.

(21) Appl. No.: 12/245,214

(22) Filed: Oct. 3, 2008

Related U.S. Application Data

(60) Provisional application No. 60/984,506, filed on Nov. 1, 2007.

(51) Int. Cl.
*E05B 67/38* (2006.01)

(52) U.S. Cl. ..... 70/56; 70/14; 70/202; 70/212; 70/417; 292/218; 292/259 R; 292/DIG. 32

(58) Field of Classification Search ..... 70/14, 54–56, 70/417, 201–203, 211, 212, DIG. 43; 292/DIG. 32, 292/218, 259 R
See application file for complete search history.

(56) References Cited

U.S. PATENT DOCUMENTS

| | | | | | |
|---|---|---|---|---|---|
| 4,372,136 | A * | 2/1983 | Mickelson | 70/14 |
| 4,877,276 | A * | 10/1989 | Pastva | 292/218 |
| 5,118,149 | A * | 6/1992 | Emmons | 292/327 |
| 5,145,222 | A * | 9/1992 | Meyer | 292/258 |
| 5,284,036 | A * | 2/1994 | Rosenbaum | 70/14 |
| D351,984 | S * | 11/1994 | Victor | D8/331 |
| 5,743,118 | A * | 4/1998 | Anderson | 70/56 |
| 5,775,747 | A * | 7/1998 | Navarsky | 292/307 B |
| 5,791,702 | A * | 8/1998 | Liroff | 292/307 R |
| 5,857,721 | A * | 1/1999 | Liroff | 292/307 R |
| 5,934,116 | A * | 8/1999 | Moore | 70/212 |
| 5,953,941 | A * | 9/1999 | Freund | 70/199 |
| 5,984,387 | A * | 11/1999 | Zeller | 292/296 |
| 6,442,982 | B1 * | 9/2002 | Larsen et al. | 70/3 |
| 6,519,982 | B1 * | 2/2003 | Brammall et al. | 70/56 |
| 6,536,815 | B1 * | 3/2003 | Liroff | 292/259 R |
| 6,553,798 | B1 * | 4/2003 | Larsen et al. | 70/211 |
| 6,581,419 | B1 * | 6/2003 | Strodtman | 70/56 |
| 6,581,425 | B1 * | 6/2003 | Brown et al. | 70/212 |
| 6,591,641 | B1 * | 7/2003 | Cann | 70/14 |
| 6,622,533 | B1 * | 9/2003 | Santini | 70/56 |
| 6,834,896 | B2 * | 12/2004 | Smith | 292/259 R |
| 6,915,670 | B2 * | 7/2005 | Gogel | 70/32 |
| 6,983,629 | B1 * | 1/2006 | Gogel | 70/14 |
| 7,162,898 | B2 | 1/2007 | Gogel | 70/14 |
| 7,210,316 | B1 * | 5/2007 | Falconer et al. | 70/2 |
| 7,249,476 | B2 * | 7/2007 | Wilson et al. | 70/94 |
| 7,272,963 | B2 * | 9/2007 | Rosenberg et al. | 70/126 |
| 7,278,663 | B2 * | 10/2007 | Witchey | 292/259 R |
| 7,380,846 | B1 * | 6/2008 | Moreno | 292/259 R |
| 7,412,856 | B1 * | 8/2008 | Gogel | 70/56 |
| 2004/0211231 | A1 * | 10/2004 | Larsen et al. | 70/34 |
| 2005/0144991 | A1 * | 7/2005 | Bravo et al. | 70/56 |
| 2007/0062227 | A1 * | 3/2007 | Thomsen | 70/56 |
| 2010/0037664 | A1 * | 2/2010 | Pitisethakarn | 70/56 |

* cited by examiner

*Primary Examiner* — Suzanne D Barrett
(74) *Attorney, Agent, or Firm* — Joseph T. Guy; Nexsen Pruet, LLC

(57) ABSTRACT

A universal security device for preventing unlocking rotation of right and left door stanchions of cargo containers including a protective housing for a puck lock and channel shaped cross bar wings extending from its laterally opposite sides. A hook with claws for engaging a stanchion includes a palm with a locking tab having a locking bar receiving opening. The palm is insertable through one of the complimentary openings provided in each of the two side walls of the housing. At least one interior tab with a locking bar receiving opening is provided in the housing and when the locking rod of a puck lock engages the openings in the locking tabs, the cross bar structure prevents an unlocking rotation of the stanchion.

20 Claims, 9 Drawing Sheets

VERSATILE CROSS BAR DEVICE FOR CONTAINER DOOR STANCHIONS

RELATED PATENT APPLICATION

Features of this invention are disclosed in U.S. provisional patent application Ser. No. 60/984,506 filed Nov. 1, 2007, for an Ambidextrous Cross Bar Security Device for Container Door Stanchions for which benefit under 35 U.S.C. 120 is claimed.

BACKGROUND OF THE INVENTION

Shackled Padlocks securing the doors of tractor trailers, storage containers, trailers and vans are cut by thieves who use a variety of cutting tools such as acetylene cutting torches, grinders, saws, and the like. Bolt cutters continue to be a commonly used tool for cutting padlocks because of their portability and reduced time, light, and sound generation. Thus there is a need to secure such doors without use of shackled padlocks, capitalizing on the inherent door structure and minimizing the points of exposure. As such, the shackle of the lock can be cut, the body of a padlock can be secured and twisted with leverage to snap the lock, the swing latch through which the lock may be secured to the handle can be cut to eliminate the stable connection of the lock to the immobile door. The rivet on the swing latch can be drilled thereby negating the functionality of the swing latch. The operating handle can be cut allowing illicit turning of the locking rod while the lock remains in the door's latch with the now cut remaining portion of the handle resting idly. The rivet in the handle hub that affixes the operating handle to the upright locking rod can be drilled out again eliminating functionality—thus leaving the entire length of the operating handle with the locked latch on the door while having un-impeded access to turning the stanchion rod which then allows the claws at the top and the bottom of the door to become unaffixed to the body of the previously secured container or trailer. The right door is typically the only door secured by a lock because the right door's seal secures the left door. Increasing use of the Caribbean tool and other devices to bend the right door's short securing plate, and other devices that cut connecting bar locks, dictates a need to secure both doors. Whereas most containers are not owned by the shipper, holes can not be drilled and internal locking rods or mounted locks are not allowed without penalty or financial remuneration. Doors can either have one vertical locking rod or stanchion that runs the height of the door on each door or two per door for a total of four locking rods with accompanying handle hubs, operating handles, and latches. The inventor's U.S. Pat. No. 7,162,898 issued Jan. 16, 2007, shows a security device for preventing rotation of the inside stanchion securing the door hinged to the right side of the rear of a container.

SUMMARY OF THE INVENTION

The security device of this invention locks the vertical stanchion of either a right door or a left door of a cargo container. If there are two locking rods on each door for a total of four rods on the container, the rods can be secured individually using one device per rod. The security device includes a cross bar housing consisting essentially of a puck house for a puck lock and a pair of aligned channel bar wings extending from laterally opposite sides of the puck house. The security device also includes a stanchion hook with vertically spaced claws that slide under and partly around the vertical stanchion on vertically opposite sides of a hub on the stanchion to which an operating handle is pivotally connected by a pivot pin or rivet. The stanchion hook is designed for universal application. It accommodates stanchion rods that open either in a clockwise direction or in a counter-clockwise direction. Similarly, the cross bar housing is designed such that it can accommodate installation of the hook at either of its laterally opposite sides; hence the ambidexterity of its application. The puck house has a cavity for a hockey puck type lock and includes two parallel tabs in the cavity which have aligned vertical openings for reception of the locking bar of the lock. The hook includes a flat projection or palm which fits in either one of two guide ways in the puck house and includes a tab with an opening that is also engageable by the locking bar of the puck lock. One of the two channel bar wings covers the handle hub permanently affixed to the stanchion when the device is installed, thereby preventing rotation of the stanchion and maintaining the stanchion in a locked position. When the device is locked to the stanchion, the shackle-less puck lock is protected by the walls of the puck house defining the cavity in which the lock rests.

BRIEF DESCRIPTION OF THE DRAWINGS

One embodiment of the invention is illustrated in the drawings in which.

DETAILED DESCRIPTION OF THE INVENTION

Figure 1:
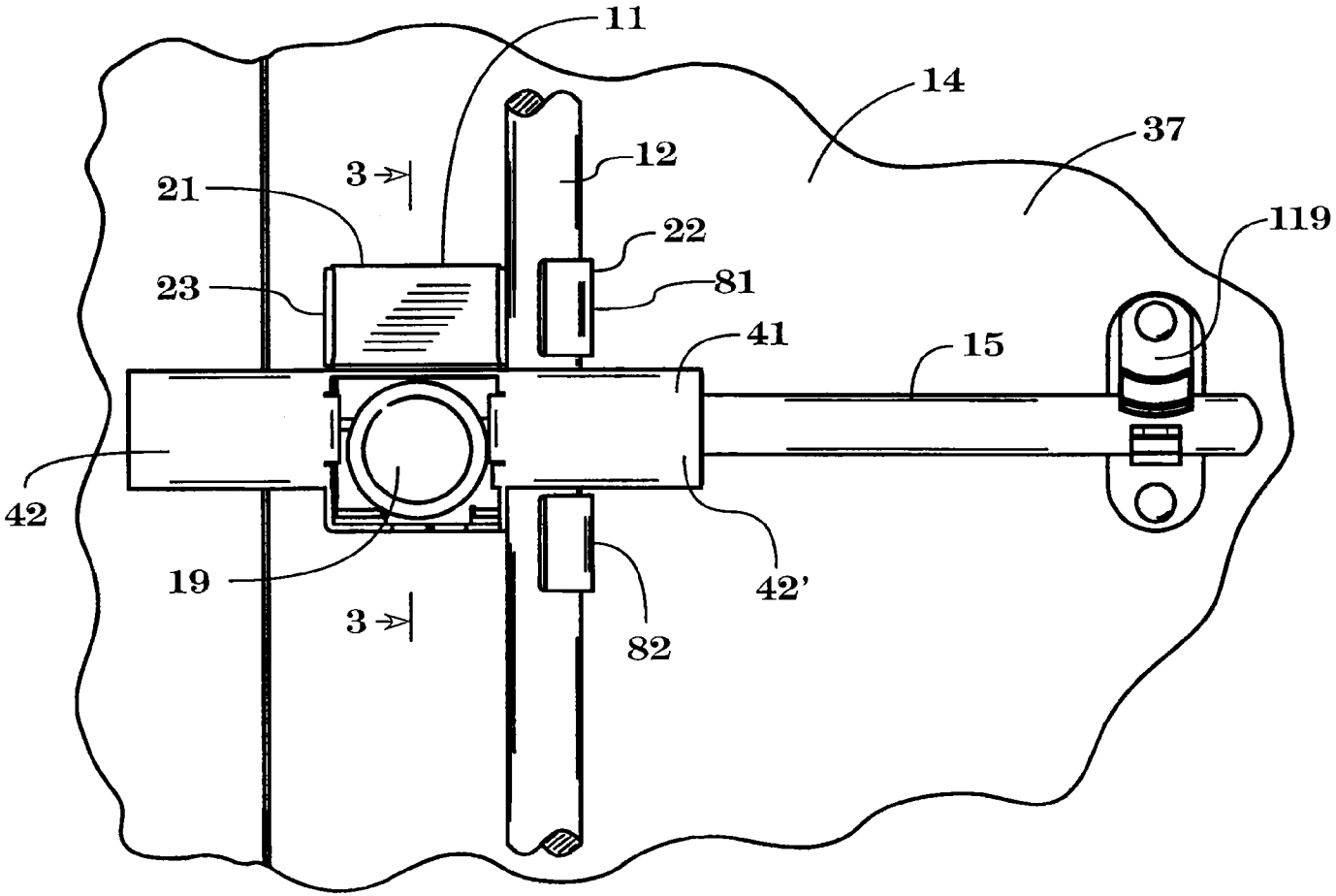
FIG. 1 is a front view of a security device installed on a right door stanchion.
Figure 2:
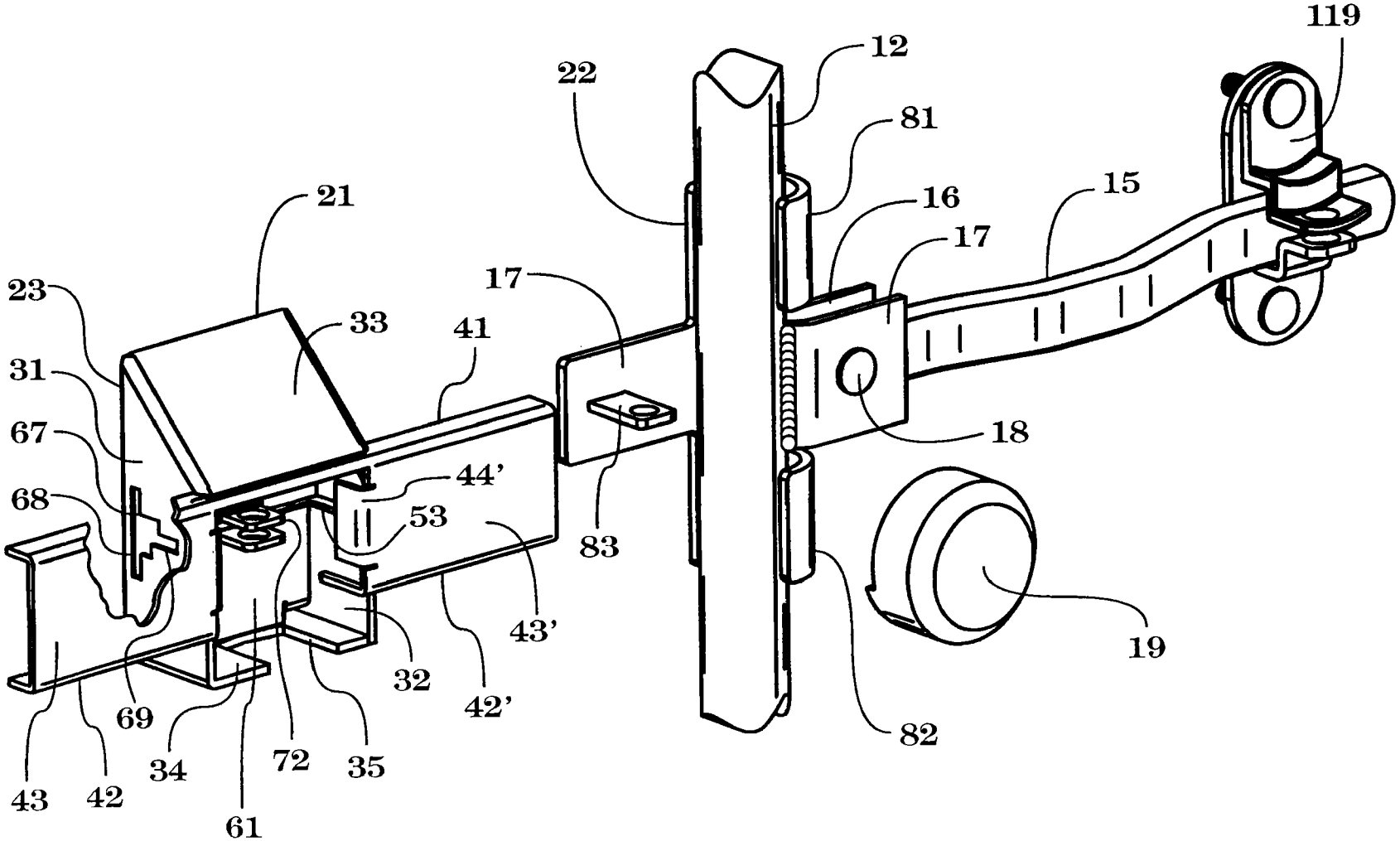
FIG. 2 is an exploded perspective of the security device of FIG. 1.

FIG. 1 shows the security device 11 installed on the inside stanchion 12 for the right hand rear door 14 of a tractor-trailer or the outside stanchion on a left door of a tractor trailer or storage container, etc., simply herein referred to as tractor-trailer. The security device 11 is portable. It attaches only to the stanchion 12. The stanchion 12 is a cylindrical rod journaled on the door 14 for pivotal movement about its axis between locking and unlocking positions. The stanchion 12 has latching fingers, not shown, at its top and bottom, which engage keeper pockets in the trailer when the stanchion 12 is pivoted about its axis. Referring also to FIG. 2, a stanchion operating handle 15 is pivotally connected by a pivot pin in the form of a rivet 18 to a handle hub formed by a pair of parallel pivot brackets 16, 17 welded to the stanchion 12. The stanchion 12 is releasably retained in its locking position by a retainer catch 119 securing the handle 15 and a padlock, not shown, securing the catch 119.

Figure 3:
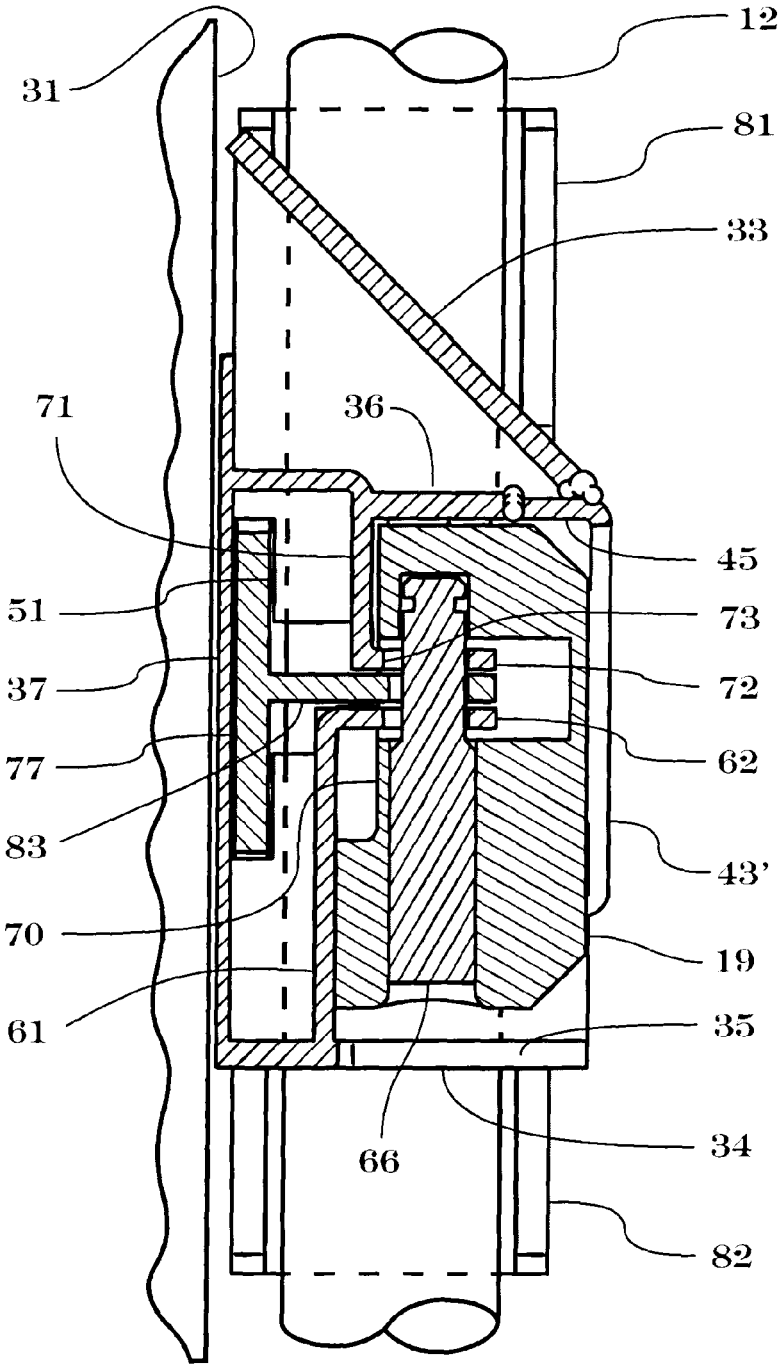
FIG. 3 is a section taken on line 3-3 in FIG. 1.
Figure 7:
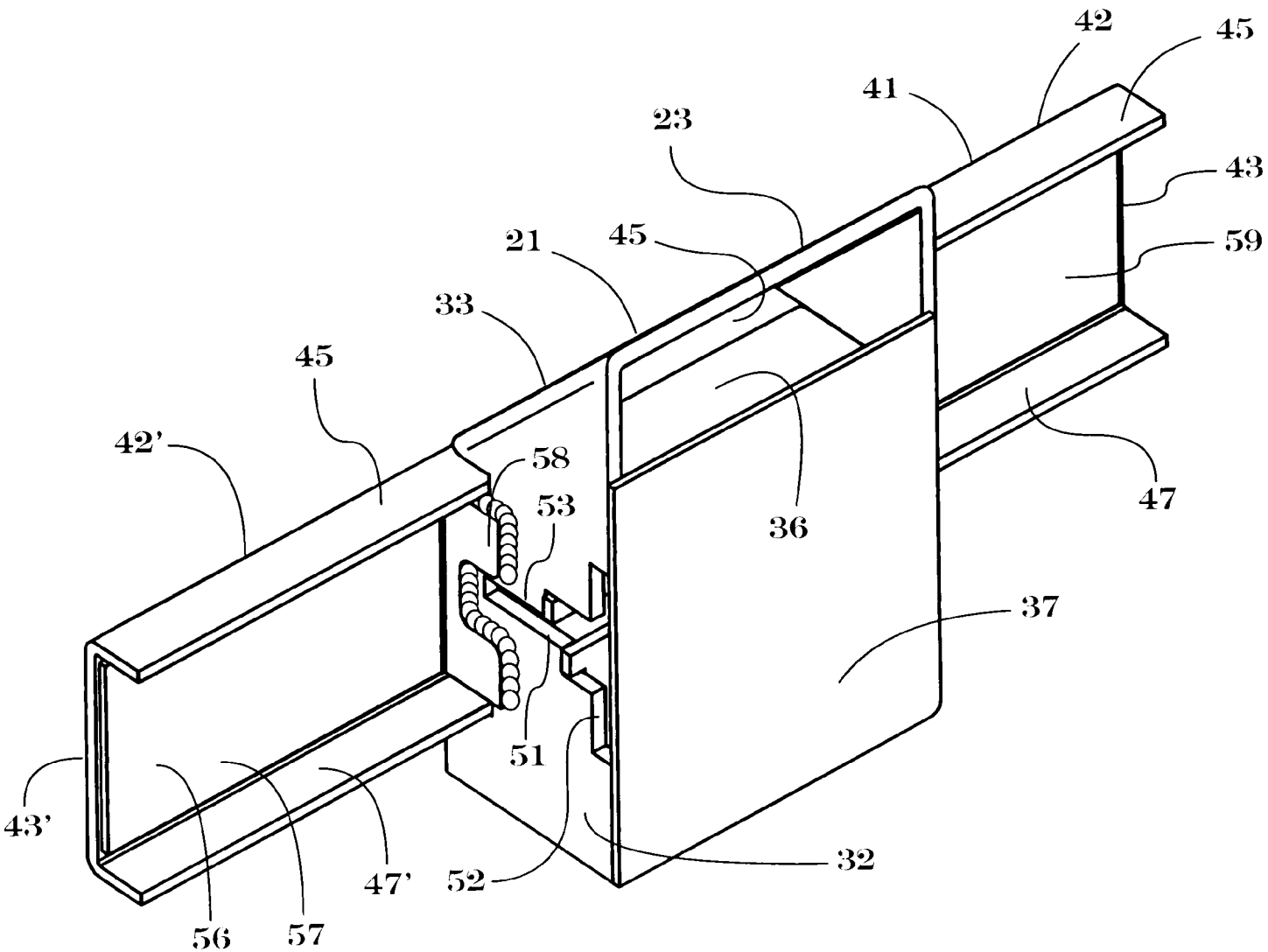
FIG. 7 is a rear perspective of the cross bar housing.
Figure 8:
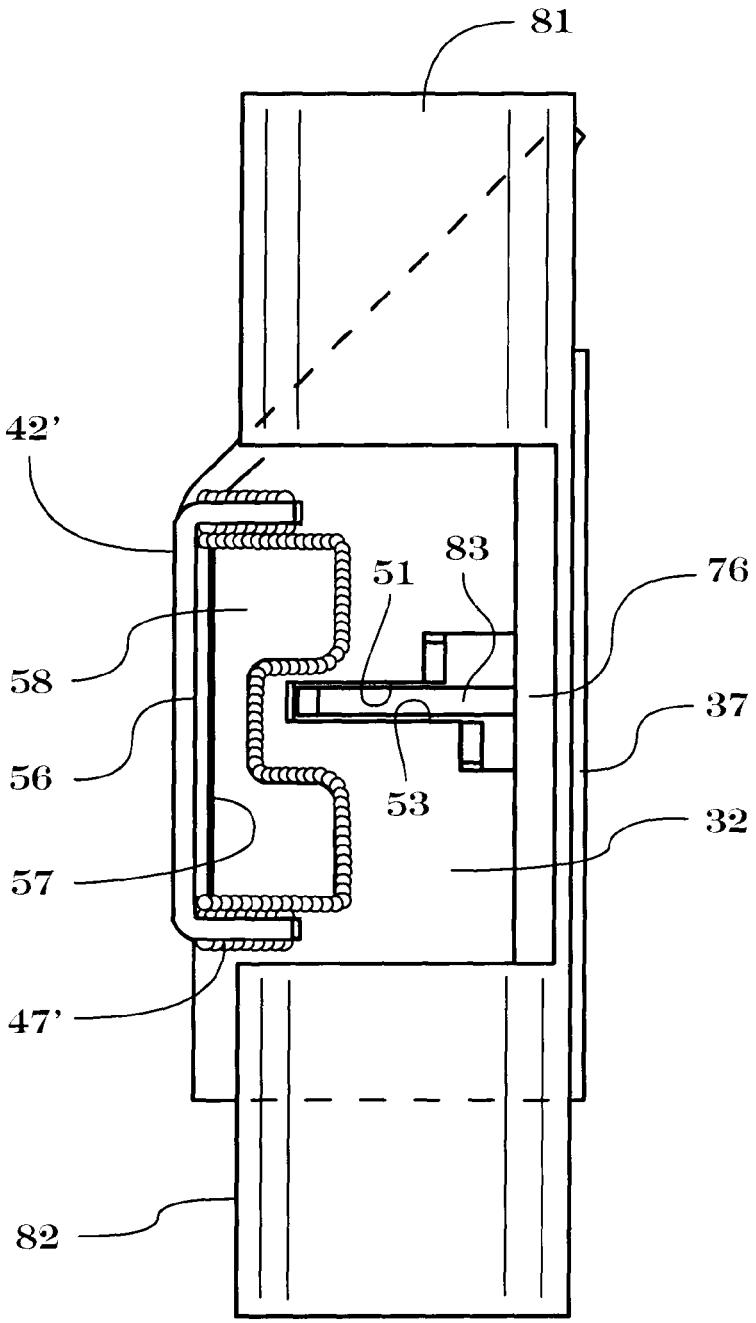
FIG. 8 is a side view of the cross bar housing with a stanchion hook installed therein and FIG. 9 is a front view of the security device installed on the stanchion securing the left rear door of a tractor trailer.

As shown in the accompanying drawings, the security device 11 has two main components, namely, a cross bar housing 21 and a stanchion hook 22. The cross bar housing 21 includes a puck house 23 having a pair of laterally spaced vertical side walls 31, 32, a sloping roof 33, a bottom wall 34, a horizontal top or ceiling wall 36 and a vertical back wall 37. The puck house 23 also includes a first intermediate vertical wall 61 welded to the bottom wall 34 and the side walls 31, 32 and an intermediate vertical wall 71 welded to the ceiling wall 36 and the side walls 31, 32. The intermediate vertical walls 61, 71 are parallel to the back wall 37. The side walls 31, 32, the bottom wall 34, the upper or ceiling wall 36, the back wall 37 and the intermediate walls 61, 71 are rigidly interconnected, as by welding, and form a pocket or cavity 38 for a puck lock 19. The front to rear stepped relationship of the intermediate vertical walls 61, 71 matches the stepped rear surface 70 of the puck lock 19, as shown in FIG. 3. The lower wall 34 has a rearward extending slot 35 which affords access to the key entrance of the puck lock 19. The cross bar housing 21 includes a channel shaped channel bar 41 rigidly secured to the side walls 31, 32, respectively. The channel bar 41 has laterally opposite extending wings 42, 42' with respective vertical webs 43, 43' with 90° degree inward bent ends 44, 44' which are welded to the opposing inside surfaces of the vertical walls 31, 32 of the puck house 23. The channel bar 41 includes an upper flange 45 which extends through horizontal slots in the side walls 31, 32 and is welded to the top wall 36 and to the side walls 31, 32. The lower flanges 47, 47' of the channel bar wings 42, 42' have inner ends which extend slightly through slots in the side walls 31, 32 and are welded to the side walls 31, 32. Referring to FIGS. 7 and 8, the wing 42' is reinforced by a supporting bracket 56 having a transverse plate 57 welded to the back of the web 43' and a C shaped end portion 58 bent 90° rearwardly and welded to the laterally outer side of the side wall 32. A supporting bracket 59, which is a reverse image of support bracket 56, is likewise welded to the rear of the web 43 and to the side wall 31. Supporting brackets 56, 59 greatly strengthen the wings 42, 43' of the channel bar 41 thereby affording marked resistance to prying action of vandals.

Figure 6:
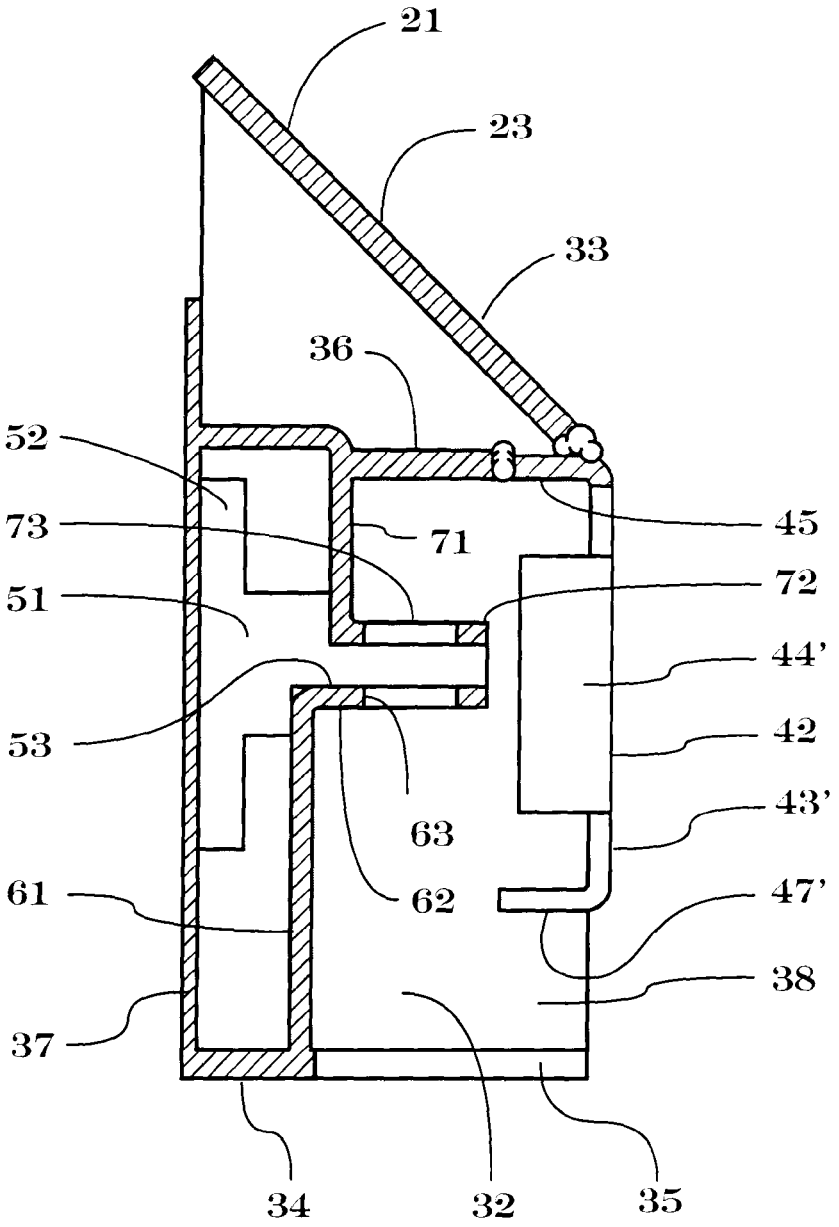
FIG. 6 is a section taken on line 6-6 in FIG. 5.

As shown in FIGS. 3 and 6, a forward extending horizontal tab 62 is rigidly secured to the upper end of the intermediate vertical wall 61 and includes an annular vertical opening 63. A forwardly extending horizontal tab 72 with an annular vertical opening 73 is integral with and extends forward from the intermediate vertical wall 71. The openings 63, 73 are in vertical alignment for reception of a locking rod 66 of the puck lock 19. As shown in FIGS. 3, 6, 7 and 8, a pair of aligned T-shaped slots 51, 67 are formed in side walls 31, 32 respectively, for reception of the stem 77 and bracket 83 of the hook 22 as shown in FIG. 2. The T-shaped slot 51 has a vertical portion 52 and a horizontal portion 53 and the T-shaped slot 67 has vertical portion 68 and a corresponding horizontal portion 69. The vertical portions 52, 68 are parallel to and adjacent the rear wall 37 of the housing 21.

Figure 4:
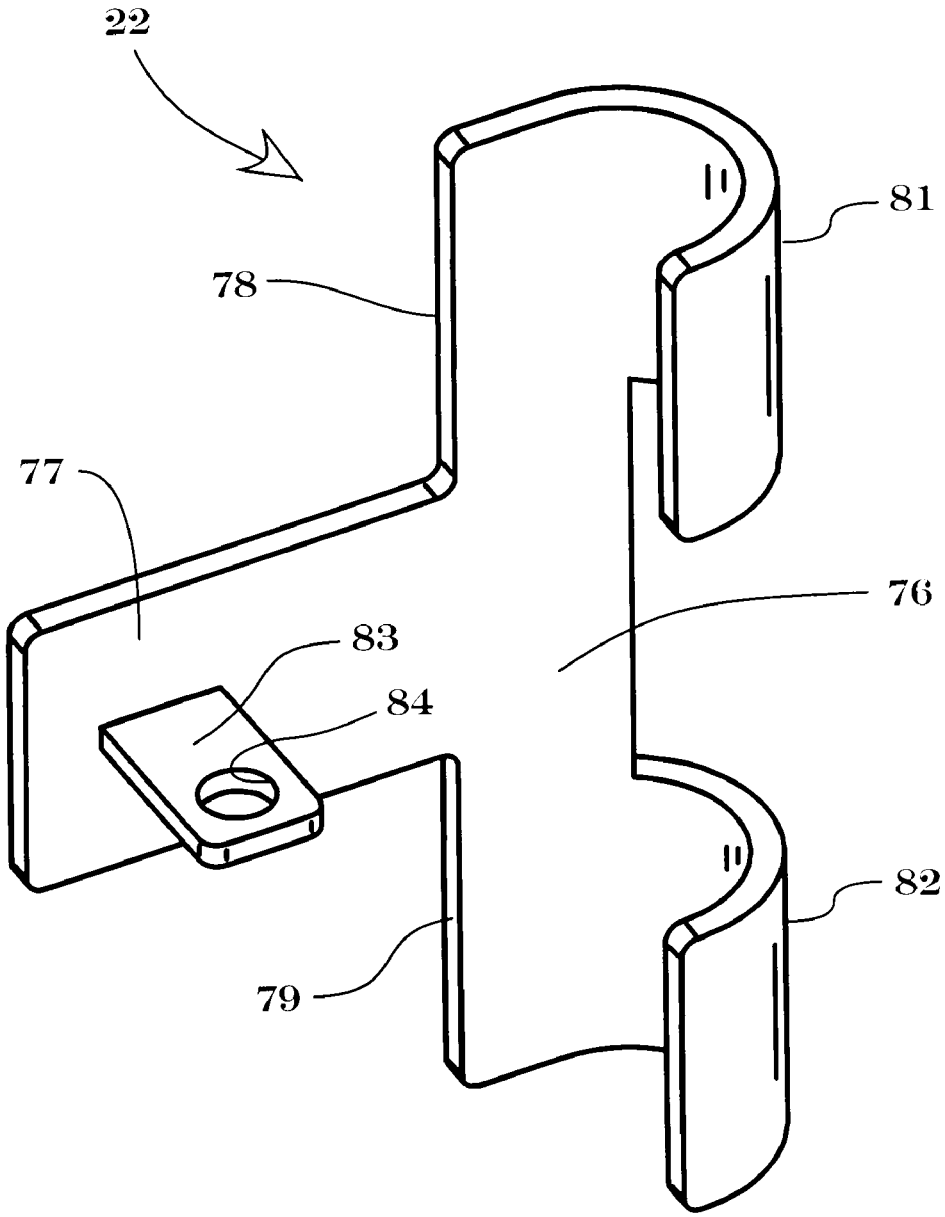
FIG. 4 is a perspective of the stanchion hook.
Figure 5:
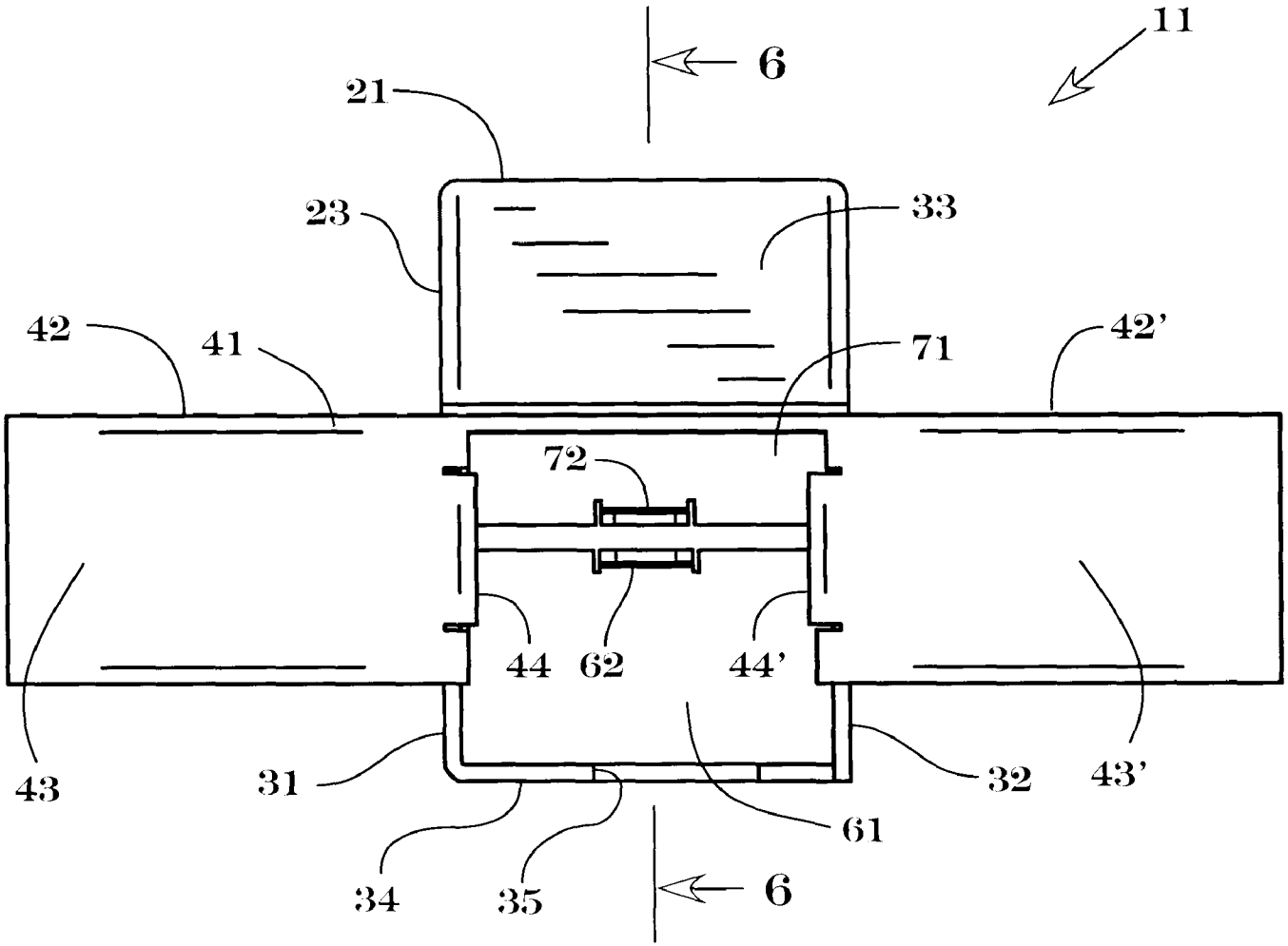
FIG. 5 is a front view of the cross bar housing.

Referring to FIG. 4, the stanchion hook 22 includes a T-shaped flat palm 76 having a stem 77, limbs 78, 79 extending from one end of the stem 77 and stanchion engaging claws 81, 82 extending from the limbs 78, 79, respectively. As shown in FIGS. 1, 2 and 3, the claws 81, 82 are adapted to pass beneath and partially encircle the stanchion 12 on opposite vertical sides of the handle hub or pivot brackets 16, 17. When so installed the claws 81, 82 engage the pivot brackets 16, 17 to maintain the vertical position of the security device 11. A locking tab 83 is rigidly secured to and extends at a right angle from the flat stem 77. The locking tab 83 has an annular opening 84 which, upon installation of the hook 22 in the housing 21, aligns with the openings 63, 73 in the locking tabs 62, 72, thereby permitting reception of the locking rod 66 of the puck lock 19, as shown in FIG. 3.

Figure 9:
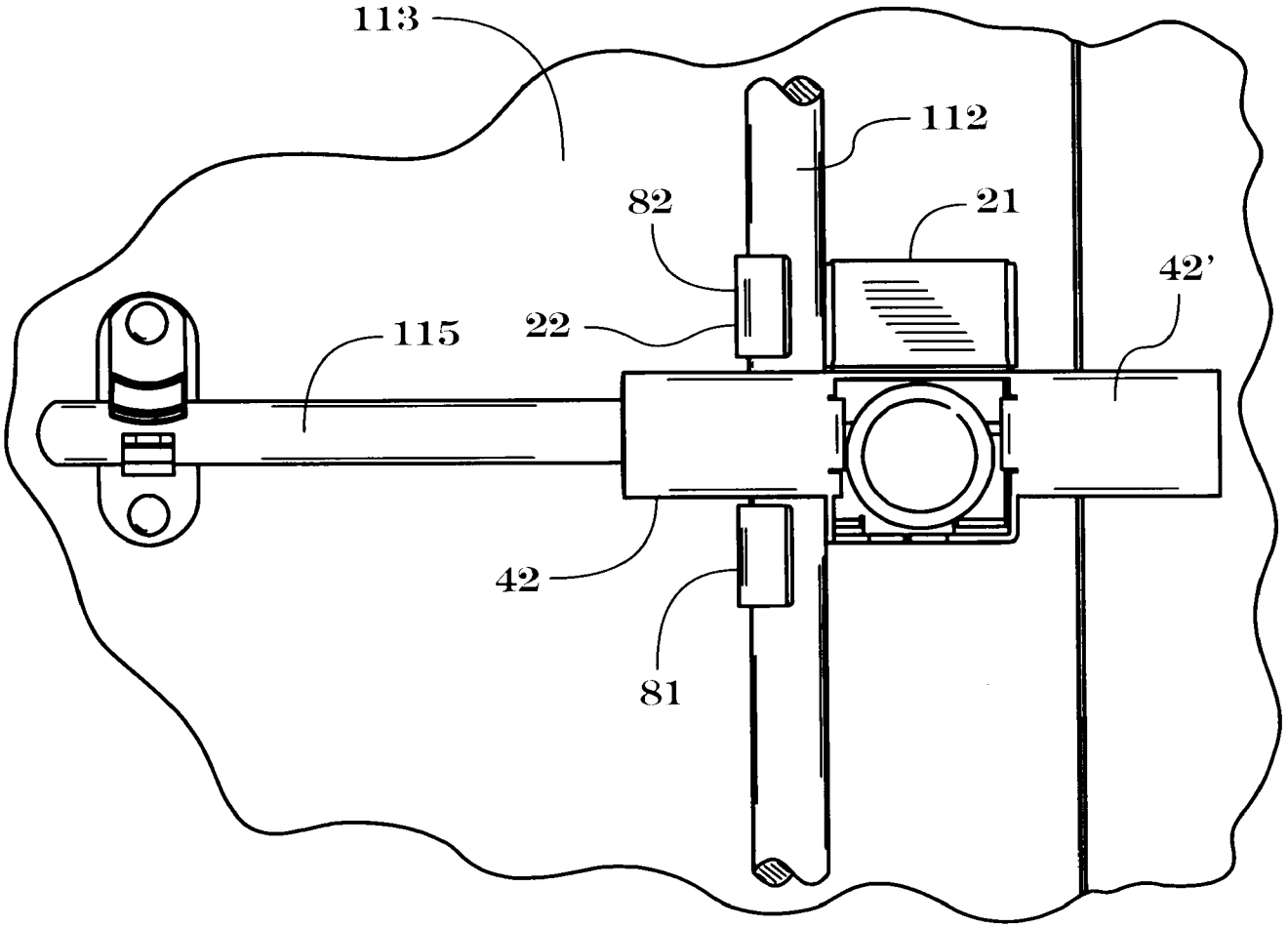

As illustrated in FIG. 9 the universal security device is shown securing the inner stanchion 112 for a door 113 having its left side hinged to a container on a vertical axis. The channel bar wing 42 covers the stanchion lever 115 and its pivot connection with the stanchion 112, thereby preventing unlocking rotation of the stanchion 112. This security feature is also applicable to the other stanchion on the right door.

The substantially symmetrical design of the cross bar housing 21 and the hook 22 allow the illustrated security device to be used to secure vertical stanchions which are rotated in different directions to unlock doors. This advantageous feature with major redesign of earlier art has been achieved at minimum increase in manufacturing cost.

What is claimed is:

1. A security device for a stanchion securing a container or trailer door of the type having a vertical stanchion rod that is pivotable about a vertical axis between door locking and door unlocking positions and to which an operating handle is pivotally connected on a horizontal axis by a handle hub, said security device comprising:

a cross bar structure including;

a lock receiving house having a vertical rear wall;

a pair of laterally spaced vertical side walls rigidly secured to and extending forward from said rear wall, said side walls having aligned T-shaped openings with a vertical component adjacent said rear wall and a horizontal component which intersects said vertical component intermediate its vertically opposite ends, a bottom wall rigidly secured to said rear and side walls and having a forward opening slot, a horizontally extending ceiling wall rigidly secured to said rear, and side walls, a first intermediate vertical wall rigidly secured to said ceiling and side walls and extending downwardly from said ceiling wall and terminating adjacent said horizontal component of said T-shaped slot, a second intermediate vertical wall rigidly secured to said side and bottom walls and extending upwardly from said bottom wall and terminating adjacent to said horizontal component of said T-shaped slot, said first and second intermediate walls being parallel to said rear wall and together with said side and ceiling walls forming a lock receiving house with a front opening, a first locking tab rigidly secured to and extending forwardly of the lower end of said first intermediate vertical wall;

a second locking tab rigidly secured to and extending forwardly from said second intermediate vertical wall;

an annular vertical opening in each of said locking tabs, said openings being aligned and adapted for reception of a locking plunger of a puck lock, a channel bar structure including a pair of horizontally aligned channel bar wings rigidly secured to and extending in laterally opposite directions, respectively, from said side walls adjacent to said front opening of said lock receiving house, each of said channel bar wings having a vertical web and a pair of vertically spaced flanges extending rearwardly from said web, a stanchion hook including a palm with a flat stem a locking tab with a vertical opening rigidly secured to and extending horizontally from said stem, and a pair of vertically spaced aligned claws rigidly secured to said palm, said claws being spaced from one another a distance greater than the vertical width of said handle hub of said lever to said stanchion rod, said stem being insertable in said T-shaped slot in one of said side walls to bring said vertical opening in said locking tab on said stanchion hook into alignment with said vertically aligned openings in said locking tabs on said interior vertical walls, when said security device is installed, said stanchion hook engages said stanchion rod with its claws on vertically opposite sides of said handle hub and said stem extends through said vertical component of said T-shaped opening in one of said side walls whereby said channel bar wing extending from said one side wall of said lock receiving house covers said handle hub preventing rotation of the associated stanchion rod to said door unlocking position and said opening in said locking tabs are aligned for reception of said puck lock.

2. The security device of claim 1 wherein said intermediate vertical walls are spaced different distances from said rear wall to accommodate a stepped construction of the rear surface of a puck lock.

3. The security device of claim 1 wherein said lock receiving house includes a front to rear upward sloping roof.

4. The security device of claim 1 wherein said back wall is in abutting relation to said container door when said security device is installed.

5. A security device for a vertically disposed storage container stanchion to which a handle is pivotally connected by a handle hub, comprising:

a housing structure having an open front permitting insertion of a puck lock, a vertical rear wall, a pair of laterally spaced vertical side walls rigidly secured to and extending forwardly from said rear wall, said side walls having horizontally aligned openings each of which have a vertical slot and a horizontal slot intersecting said vertical slot, a top wall, a bottom wall with an opening at said open front, a first intermediate vertical wall extending from said top wall to said horizontal slot and including a horizontal locking tab with a vertical opening rigidly secured thereto adjacent to said horizontal slot, a second intermediate wall extending from said bottom wall to said horizontal slot and including a horizontal locking tab with a vertical opening rigidly secured thereto and adjacent to said horizontal slot, a side, top, bottom, a pair of aligned channels secured to and extending laterally outward from a forward part of said side walls, respectively, said channels having vertically spaced horizontal flanges extending rearward, a hook having a flat palm including a locking tab rigidly secured to and extending at a right angle to said palm and having an opening for receiving the locking rod of a puck lock, and a pair of claws rigidly secured to said flat palm in spaced relation to one another by a distance permitting said claws to engage said stanchion at vertically opposite sides, respectively of said handle hub, said flat palm being insertable in said opening in a selected one of said side walls whereby said opening in said tab on said palm is aligned with said openings in said locking tabs on said intermediate walls and said openings are adapted to receive the locking rod of a puck lock positioned in said housing.

6. A security device for a vertical stanchion rod pivotable stanchion rod pivotable about its vertical axis by an operating handle pivotally connected on a horizontal axis to a handle hub on the stanchion rod, said security device comprising:

a housing having a rear wall, a top wall, a bottom wall having a front to rear extending recess, a pair of side walls having horizontally aligned T-shaped openings wherein each of said openings has a vertical component adjacent to said rear wall and a horizontal component extending forward from the mid section of said vertical component, a first intermediate wall parallel to said rear wall and extending downwardly from said top wall to said horizontal components of said T-shaped openings, a second intermediate wall parallel to said rear wall extending upwardly from said bottom wall to said horizontal components of said T-shaped openings, a first horizontal tab rigidly secured to and extending forward from the lower end of said first intermediate wall, a second horizontal tab rigidly secured to and extending forwardly from the upper end of said second intermediate wall, said top wall, side walls, bottom wall and intermediate walls forming a cavity adapted to receive a puck lock, a cross bar structure including oppositely extending aligned channel segments rigidly secured to and extending laterally outward from said side walls, respectively, said channel segments each having a vertical web and parallel horizontal flanges extending rearwardly from the upper and lower ends of said webs, respectively, and a hook having a flat palm and a pair of vertically spaced claws curving forwardly from said palm, said claws being spaced apart a distance slightly greater than the vertical width of said handle hub and adapted to partially encircle said stanchion rod, said flat palm being insertable through a selected one of said T-shaped openings and having a locking tab with a vertical opening which is alignable with said vertical openings in said tabs secured to said intermediate walls and when so aligned are adapted to receive the locking rod of a puck lock positioned in said cavity.

7. The security device of claim 6 wherein said housing includes a front to rear upward sloping roof.

8. The security device of claim 6 wherein said vertical openings in said tabs are positioned midway between said side walls.

9. A security device for a vertical stanchion rod pivotable about its vertical axis by an operating handle pivotally connected on a horizontal axis to a handle hub on the stanchion rod, said security device comprising:

a housing having a rear wall, a top wall, a bottom wall having a front to rear extending recess, a pair of side walls having horizontally aligned T-shaped openings wherein each of said openings has a vertical component adjacent to said rear wall and a horizontal component extending forward from a mid section of said vertical component, an intermediate vertical wall parallel to said rear wall, said intermediate vertical wall extending from one of said bottom and top walls and terminating at said horizontal components of said T-shaped openings, a horizontal tab rigidly secured to said intermediate vertical wall adjacent to said horizontal components of said T-shaped openings, said top, side, bottom and intermediate walls forming a cavity adapted to receive a puck lock, a cross bar structure including oppositely extending aligned channel segments rigidly secured to and extending laterally outward from said side walls, respectively, said channel segments each having a vertical web and parallel horizontal flanges extending rearwardly from the upper and lower ends of said webs, respectively, and a hook having a flat palm and a pair of vertically spaced claws curving forwardly from said palm, said claws being spaced apart a distance slightly greater than the vertical width of said handle hub and adapted to partially encircle said stanchion rod, said flat palm being insertable through either one of said T-shaped openings and having a locking tab with a vertical opening which is alignable with said vertical opening in said tab secured to said intermediate wall and when so aligned, said vertical openings are adapted to receive the locking rod of a puck lock positioned in said cavity.

10. The security device of claim 9 wherein said housing includes a front to rear upward sloping roof.

11. The security device of claim 9 wherein said vertical opening in said tab on said intermediate vertical wall is positioned midway between said side walls.

12. A security device for a container door secured by a vertical stanchion rod pivotable about its vertical axis by an operating handle pivotally connected on a horizontal axis to a handle hub on the stanchion rod, said security device comprising:

a housing having a rear wall, a top wall, a bottom wall, a pair of side walls having horizontally aligned hook access openings wherein each of said hook access openings has a vertically extending component adjacent to said rear wall and a horizontal component extending forward from said vertically extending component, an intermediate vertical wall parallel to said rear wall extending from one of said bottom and top walls and terminating at said horizontal components of said hook access openings, a horizontal tab rigidly secured to said intermediate vertical wall adjacent said horizontal components of said hook access openings and including a vertical opening, said top, side, bottom and intermediate walls forming a cavity adapted to receive a puck lock, a cross bar structure including laterally opposite extending aligned channel segments with laterally inward ends rigidly secured to and extending laterally outward from said side walls, respectively, said channel segments each having a vertical web and parallel horizontal flanges extending rearwardly from the upper and lower ends of said webs, respectively, and a hook having a flat palm and a pair of vertically spaced claws curving forwardly from said palm, said claws being spaced apart a distance slightly greater than the vertical width of said handle hub and adapted to partially encircle said stanchion rod, said flat palm being insertable through a one of said hook access openings and having a locking tab with a vertical opening which is alignable with said vertical opening in said tab secured to said intermediate wall and when so aligned, said vertical openings are adapted to receive the locking rod of a puck lock positioned in said cavity.

13. The security device of claim 12 wherein said housing includes a front to rear upward sloping roof.

14. The security device of claim 12 wherein said vertical opening in said tab on said intermediate vertical wall is positioned midway between said side walls.

15. The security device of claim 12 wherein said rear wall has a flat abutting relationship with said container door.

16. The security device of claim 12 wherein said webs have laterally inward end which, respectively, extend rearwardly 90° and are welded, respectively to the laterally inner sides of said side walls of said housing.

17. The security device of claim 12 wherein said hook is symmetrical.

18. The security device of claim 12 wherein in its installed condition one of said channel segments covers said handle hub and prevents rotation of said stanchion rod.

19. The security device of claim 12 including a pair of supporting brackets having transverse plates welded respectively, to the rear sides of said vertical webs and including rearwardly extending end portions welded, respectively, to the laterally outer sides of said side walls.

20. A security device for a container door secured by a vertical stanchion rod pivotable about its vertical axis by an operating handle pivotally connected on a horizontal axis to a handle hub on the stanchion rod, said security device comprising:

a housing having a rear wall, a top wall, a bottom wall, a pair of side walls having horizontally aligned hook access openings, said top, side and bottom walls forming a cavity adapted to receive a puck lock, an interior wall having first a tab with a vertical opening and, a cross bar structure including laterally opposite extending aligned segments with laterally inward ends rigidly secured to and extending laterally outward from said side walls, respectively, and a hook having a palm and a pair of vertically spaced claws curving forwardly from said palm, said claws being spaced apart a distance slightly greater than the vertical width of said handle hub and adapted to partially encircle said stanchion rod, said flat palm being insertable through a selected one of said hook access openings and having a second locking tab with a vertical opening which is alignable with said vertical opening in said first tab secured to said interior wall and when so aligned, said vertical openings are adapted to receive the locking rod of a puck lock positioned in said cavity.

* * * * *